US010252485B2

(12) United States Patent
Aoyagi et al.

(10) Patent No.: US 10,252,485 B2
(45) Date of Patent: Apr. 9, 2019

(54) SHEET BINDING PROCESSING APPARATUS, SHEET POST-PROCESSING APPARATUS HAVING THE SHEET BINDING PROCESSING APPARATUS, AND IMAGE FORMING SYSTEM HAVING THE SHEET POST-PROCESSING APPARATUS

(71) Applicants: Hideki Aoyagi, Misato (JP); Hongchang Sun, Yamanashi-ken (JP)

(72) Inventors: Hideki Aoyagi, Misato (JP); Hongchang Sun, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/704,599

(22) Filed: Sep. 14, 2017

(65) Prior Publication Data

US 2018/0104926 A1 Apr. 19, 2018

(30) Foreign Application Priority Data

Sep. 14, 2016 (JP) ..... 2016-179232
Sep. 14, 2016 (JP) ..... 2016-179233

(51) Int. Cl.
*B31F 5/02* (2006.01)
*B65H 37/04* (2006.01)
(Continued)

(52) U.S. Cl.
CPC ..... *B31F 5/027* (2013.01); *B42C 1/12* (2013.01); *B65H 31/02* (2013.01); *B65H 31/34* (2013.01); *B65H 31/36* (2013.01); *B65H 31/38* (2013.01); *B65H 37/04* (2013.01); *B65H 43/00* (2013.01); *B65H 43/04* (2013.01); *B65H 43/08* (2013.01); *G03G 15/6541* (2013.01); *B65H 2301/4212* (2013.01); *B65H 2301/4213* (2013.01); *B65H 2301/43828* (2013.01);
(Continued)

(58) Field of Classification Search
CPC ..... B42C 1/12; B31F 1/07; B31F 5/02; B31F 2201/0779; B31F 2201/0712; G03G 2215/00852; G03G 15/6544; B65H 31/34; B65H 37/04; B65H 43/02; B65H 43/04; B65H 2301/43828; B65H 2301/51616
USPC ..... 270/58.07, 58.08, 58.09, 58.11, 58.12, 270/58.17
See application file for complete search history.

(56) References Cited

U.S. PATENT DOCUMENTS 4,170,346 A * 10/1979 Murray ..... B42C 1/12 270/1.02
5,140,380 A * 8/1992 Nakamura ..... B42C 1/12 270/58.05
(Continued)

FOREIGN PATENT DOCUMENTS

JP 2015-054490 A 3/2015

*Primary Examiner* — Leslie A Nicholson, III
(74) *Attorney, Agent, or Firm* — Manabu Kanesaka

(57) ABSTRACT

A sheet binding processing apparatus including a crimp binding member that performs binding processing on a predetermined region of a sheet by sandwiching and pressing the sheet between an upper tooth and a lower tooth meshing with each other, and a detection unit that detects a state of the predetermined region of the sheet to be bound by the crimp binding member. If the detection unit detects that the predetermined region is not capable of binding, the binding processing on the predetermined region is prohibited.

14 Claims, 14 Drawing Sheets

(51) Int. Cl.

| | |
|---|---|
| ***B65H 31/34*** | (2006.01) |
| ***B42C 1/12*** | (2006.01) |
| ***B65H 43/04*** | (2006.01) |
| ***B65H 31/02*** | (2006.01) |
| ***B65H 31/36*** | (2006.01) |
| ***B65H 31/38*** | (2006.01) |
| ***B65H 43/00*** | (2006.01) |
| ***B65H 43/08*** | (2006.01) |
| ***G03G 15/00*** | (2006.01) |

(52) U.S. Cl.

CPC *B65H 2405/11151* (2013.01); *B65H 2407/21* (2013.01); *B65H 2408/1222* (2013.01); *B65H 2511/10* (2013.01); *B65H 2511/16* (2013.01); *B65H 2511/162* (2013.01); *B65H 2511/164* (2013.01); *B65H 2511/20* (2013.01); *B65H 2511/24* (2013.01); *B65H 2511/515* (2013.01); *B65H 2553/30* (2013.01); *B65H 2553/412* (2013.01); *B65H 2553/414* (2013.01); *B65H 2553/81* (2013.01); *B65H 2801/27* (2013.01)

(56) References Cited

U.S. PATENT DOCUMENTS

| | | | | |
|---|---|---|---|---|
| 7,396,008 | B2 * | 7/2008 | Sato | B27F 7/006 227/78 |
| 2016/0016753 | A1 * | 1/2016 | Suzuki | G05B 15/02 270/58.08 |
| 2016/0159605 | A1 * | 6/2016 | Miyahara | G03G 15/6544 270/1.01 |
| 2016/0194173 | A1 * | 7/2016 | Okada | B65H 37/04 270/58.09 |

* cited by examiner

SHEET BINDING PROCESSING APPARATUS, SHEET POST-PROCESSING APPARATUS HAVING THE SHEET BINDING PROCESSING APPARATUS, AND IMAGE FORMING SYSTEM HAVING THE SHEET POST-PROCESSING APPARATUS

BACKGROUND OF THE INVENTION

1. Field of the Invention

The present invention relates to a sheet binding processing apparatus for crimp-binding a sheet bundle, a sheet post-processing apparatus having the sheet binding processing apparatus, and an image forming system having the sheet post-processing apparatus.

2. Description of the Related Art

A sheet post-processing apparatus having a sheet binding processing apparatus that receives sheets, on which images are formed by an image forming apparatus, on a processing tray and applies binding processing to the sheet bundle on the processing tray has heretofore been known.

Among such binding apparatuses, a sheet binding processing apparatus that can apply binding processing to a sheet bundle without using a metal staple, by crimping the sheet bundle to cause entanglement of fibers of the sheets, has been provided in recent years . Such crimp binding is configured so that the sheet bundle is bound by making crimping teeth firmly bite the sheet bundle to crimp the sheets together. The crimp teeth are a pair of crimping members having a recessed and protruded shape formed by alternately arranging a plurality of recesses and a plurality of protrusions in parallel. Such crimp binding has an advantage that the sheets can be easily exfoliated and separated since the sheets are bound without passing a metal staple.

The crimp binding of sandwiching the sheets between the upper and lower protrusions and recesses can break the sheets because of the biting of the protrusions into the recesses. The biasing force for crimping is thus difficult to control. A binding apparatus has therefore been proposed in which a pair of crimping members each include protrusion (recess) of which a top (bottom) is a surface parallel to a sheet surface of a sheet, and a side surface of the protrusion (recess) is a slope tilted with respect to the sheet surface, so that if the protrusions and recesses of the pair of crimping members mesh with each other, the slopes make contact with each other and a gap is formed both between the top of the protrusion of one of the crimping members and the bottom of the recess of the other crimping member and between the top of the protrusion of the other crimping member and the bottom of the recess of the one crimping member, whereby breakage of the sheets is prevented (for example, JP2015-054490A).

SUMMARY OF THE INVENTION

To achieve the foregoing object, a sheet post-processing apparatus according to the present invention includes a crimp binding member that performs binding processing on a predetermined region of a sheet by sandwiching and pressing the sheet between an upper tooth and a lower tooth meshing with each other, and a detection unit that detects a state of the predetermined region of the sheet to be bound by the crimp binding member, wherein if the detection unit detects that the predetermined region is not capable of binding, the binding processing on the predetermined region is prohibited.

DETAILED DESCRIPTION OF THE PREFERRED EMBODIMENT

Figure 1:
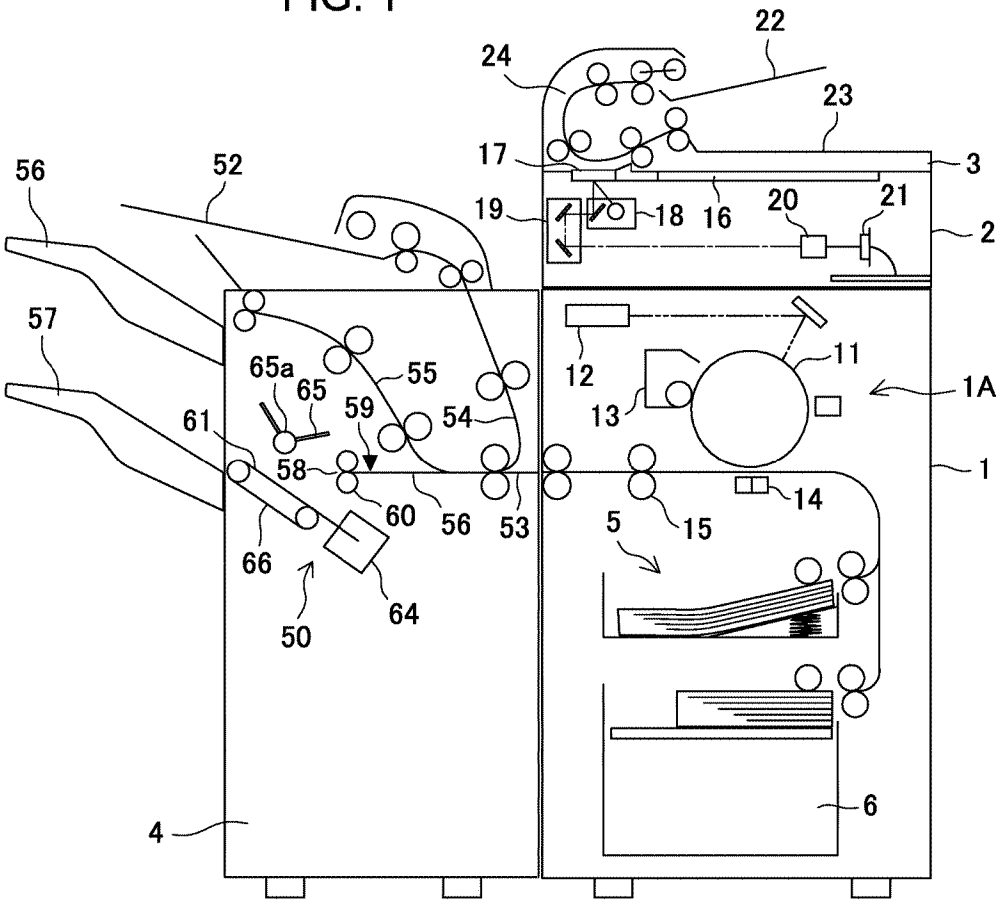
FIG. 1 shows a schematic overall configuration diagram of an image forming system including a sheet stacking apparatus according to the present invention.

FIG. 1 schematically shows an overall configuration of an image forming system including a sheet post-processing apparatus according to the present embodiment. The image forming system shown in the diagram includes an image forming apparatus 1, a document reading apparatus 2, a document feed apparatus 3, and a sheet post-processing apparatus 4. The image forming apparatus 1 includes an image forming unit that prints an image on a sheet. The document reading apparatus 2 reads an image to be printed on a sheet from a document. The document feed apparatus 3 conveys the document to a reading unit of the document reading apparatus 2. The sheet post-processing apparatus 4 is connected to a sheet discharge port of the image forming apparatus 1 and applies binding processing to a sheet discharged from the image forming apparatus 1.

[Image Forming Apparatus]

The image forming apparatus 1 includes a cassette 5 which can store about 100 sheets, and a storage 6 which can store about 1000 sheets, i.e., more than the cassette 5 can. Sheets are taken out from either the cassette 5 or the storage 6 one by one and sent to an image forming unit 1A.

The image forming unit 1A performs electrostatic printing. The image forming unit 1A includes a beam projector 12, a developing device 13, and a transfer charger 14. The beam projector 12 forms an electrostatic latent image on a photosensitive drum 11. The developing device 13 applies toner ink to the electrostatic latent image. The transfer charger 14 transfers the image ink formed on the photosensitive drum 11 to a sheet. A fixing roller 15 arranged downstream heats and fixes the image on the sheet. The sheet is conveyed to the sheet post-processing apparatus 4.

[Document Reading Apparatus]

The document reading apparatus 2 includes a first platen 16 and a second platen 17. The first and second platens 16 and 17 are made of transparent glass and horizontally juxtaposed on an upper part of the apparatus. The first platen 16 is used to read a document that is manually set. The first platen 16 is formed to a maximum size of a usable document. The second platen 17 is used to read a document that moves at a predetermined speed. The second platen 17 is therefore formed to a maximum width of a document that can be read while running.

The document reading apparatus 2 includes a reading carriage 18 and a photoelectric conversion unit inside. The photoelectric conversion unit includes a condenser lens 20 and a photoelectric conversion element 21 such as a CCD image sensor. The reading carriage 18 includes a lamp which emits light to a document, and two mirrors which guide the light reflected from the document to the condenser lens 20 and the photoelectric conversion element 21.

The reading carriage 18 is driven by a not-shown carriage motor to reciprocate in a sub scanning direction (horizontal direction) under the first platen 16 while being guided by a guide shaft. During a forward movement, the reading carriage 18 irradiates the document set on the first platen 16 with light, and reads the document by photoelectrically converting the reflected light from the document by the photoelectric conversion element 21. Image data on the document read by the photoelectric conversion element 21 is transmitted as an image signal to the beam projector 12.

[Document Feed Apparatus]

The document feed apparatus 3 passes a document set on a sheet feed tray 22 over the second platen 17 by using a sheet conveyance mechanism 24, and discharges the sheet to a sheet discharge tray 23. If a document is set on the sheet feed tray 22, the reading carriage 18 is put on standby at the position of the second platen 17 and reads the passing document.

[Sheet Post-Processing Apparatus]

The sheet post-processing apparatus 4 applies the binding processing to sheets on which images are formed by the image forming unit of the image forming apparatus 1. The sheet post-processing apparatus 4 includes a sheet binding processing apparatus 50, a first and second sheet discharge trays 56 and 57, a sheet feed tray 52, a first conveyance path 53, a second conveyance path 54, and a third conveyance path 55. The sheet binding processing apparatus 50 performs the binding processing on sheets. Sheets are discharged to the first and second sheet discharge trays 56 and 57. Sheets such as a document, color paper, and a slip sheet are set on the sheet feed tray 52. The first conveyance path 53 guides a sheet from the image forming apparatus 1 to the sheet binding processing apparatus 50. The second conveyance path 54 guides a sheet from the sheet feed tray 52 to the sheet binding processing apparatus 50. The third conveyance path 55 branches off the first conveyance path 53 and guides the sheet from the image forming apparatus 1 to the first discharge tray 56.

The sheet post-processing apparatus 4 further includes a sheet feed mechanism and a plurality of conveyance roller pairs. The sheet feed mechanism separates and feeds the sheets on the sheet feed tray 52 one by one. The plurality of conveyance roller pairs is arranged at appropriate intervals to convey sheets along the first to third conveyance paths 53, 54, and 55. A downstream portion of the first conveyance path 53 and a downstream portion of the second conveyance path 54 constitute a common conveyance path (third conveyance path) 56*a*. A discharge roller pair 60 for discharging a sheet to a discharge port 58 is arranged at the end of the common conveyance path 56*a*. A carry-out sensor 59 detects the sheet conveyed to the discharge port 58.

The sheet feed tray 52 and the second conveyance path 54 are used if the user of the image forming system intends to only bind sheets. More specifically, if sheets are placed on the sheet feed tray 52, the sheets are conveyed to the sheet binding processing apparatus 50 through the conveyance path 54 one by one so that the sheet binding processing apparatus 50 can perform a binding operation. For example, suppose that the sheet binding processing apparatus 50 performs the binding processing on sheets conveyed from the image forming apparatus 1 through the conveyance path 53, and discharges the bound sheet bundle to the sheet discharge tray 57. If the user wants to add a new sheet to the bounding-processed sheet bundle or wants to rebind an incompletely-bound sheet bundle, the user places the sheets to be rebound on the sheet feed tray 52.

[Sheet Binding Processing Apparatus]

Figure 2:
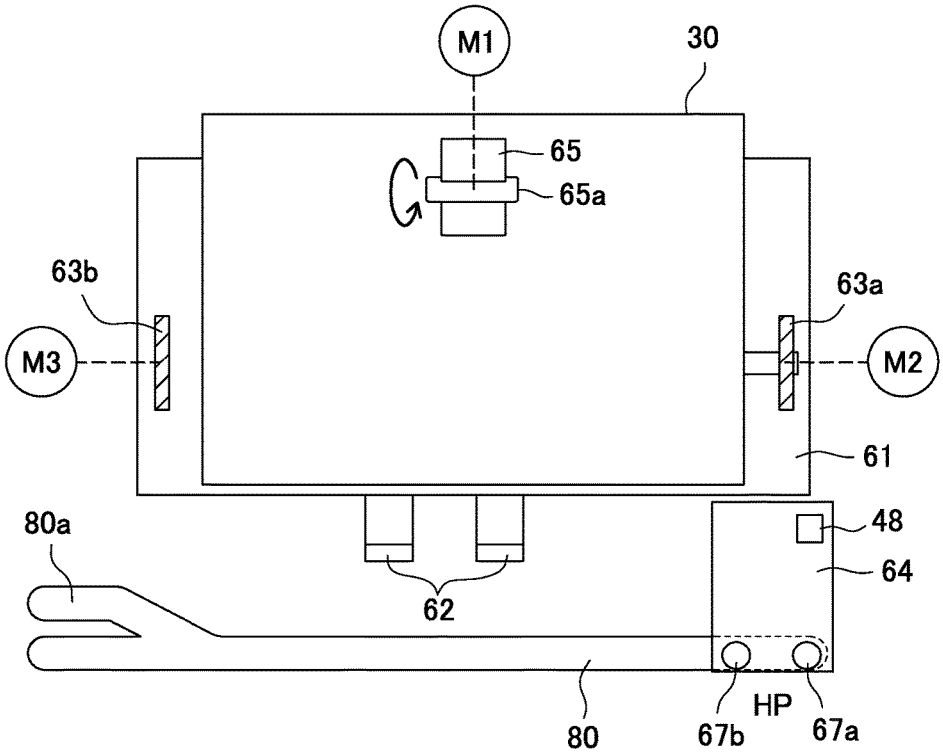
FIG. 2 is a plan view of a binding part of a sheet post-processing apparatus, showing a state in which a sheet is carried out to a processing tray.
Figure 3:
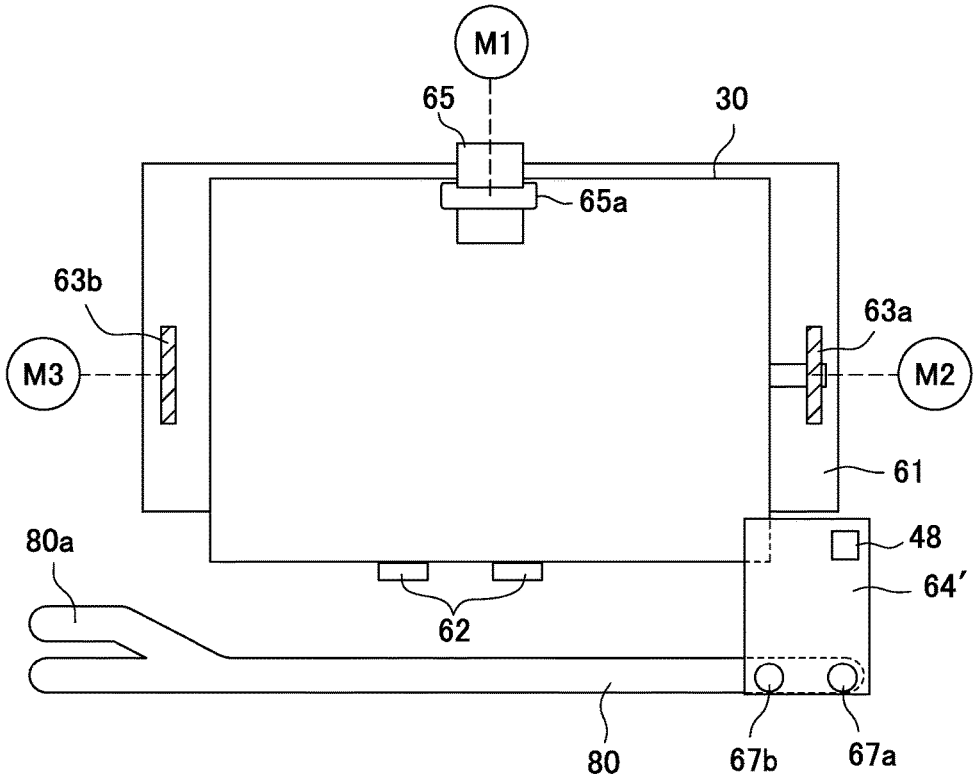
FIG. 3 shows an alignment operation of a trailing edge of the sheet carried out to the processing tray in FIG. 2.
Figure 4:
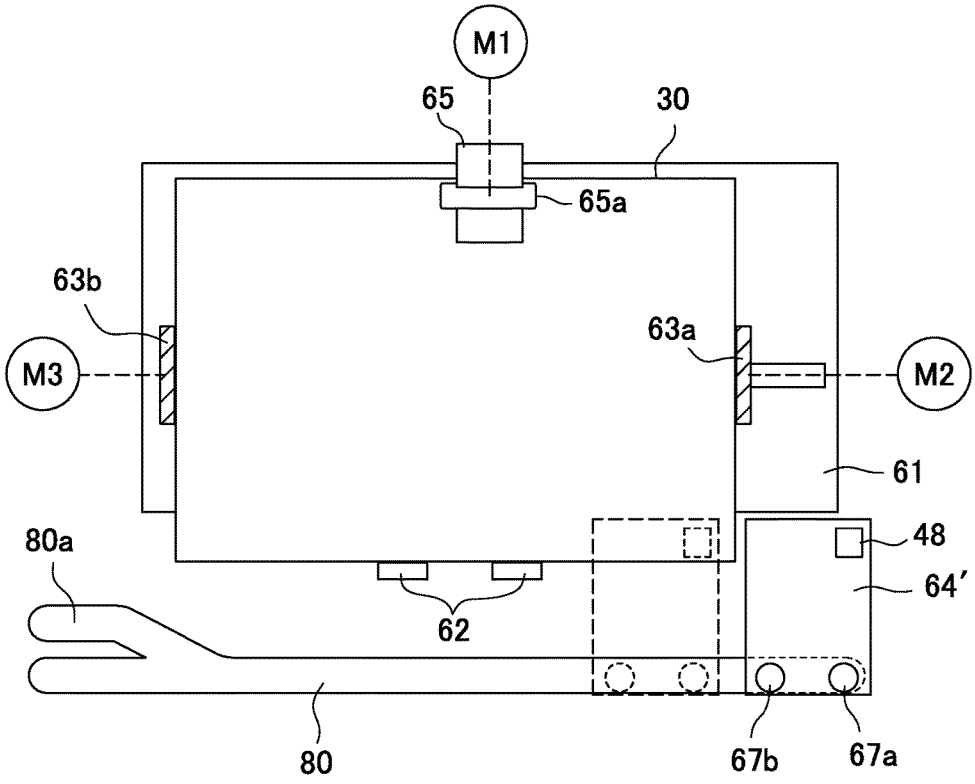
FIG. 4 shows an alignment operation of one end side of the sheet carried out to the processing tray in FIG. 3.

FIGS. 2 to 4 are plan views showing the sheet binding processing apparatus 50. The sheet binding processing apparatus 50 includes a processing tray 61, trailing edge regulation plates 62, a pair of side regulation plates (first and second side regulation plates serving as an alignment unit) 63*a* and 63*b*, a binding unit 64, a paddle 65, and a discharge belt 66 (see FIG. 1). The processing tray 61 is a placing unit for sheets 30. The trailing edge regulation plates 62 align the trailing edges of the sheets on the processing tray 61. The side regulation plates 63*a* and 63*b* align both ends of the sheets 30 in the width direction. The binding unit 64 binds the sheets 30 aligned on the processing tray 61. The paddle 65 is arranged above the processing tray 61. The discharge belt 66 discharges the sheets on the processing tray 61 to the second discharge tray 57.

The paddle 65 is rotatably supported by a rotating shaft 65*a*. The paddle 65 is driven by a paddle driving motor M1 to rotate in the direction of the arrow in FIG. 2, and thereby pushes out the sheets 30 toward the trailing edge regulation plates 62.

The discharge belt 66 is stretched between a pair of pulleys. The discharge belt 66 is driven by a discharge motor M5 (FIG. 6) to discharge the sheets on the processing tray 61 to the sheet discharge tray 57.

The side regulation plates 63*a* and 63*b* are provided on the left and right side ends of the processing tray 61, with the sheets 30 therebetween. The side regulation plates 63*a* and 63*b* are connected to a left side shift motor M2 and a right side shift motor M3, respectively, via not-shown rack mechanisms. The side regulation plates 63*a* and 63*b* are thus configured to be capable of reciprocation in the width direction of the sheets 30 according to forward and reverse rotations of the respective side shift motors M2 and M3.

Sheets sequentially discharged from the first and second conveyance paths 53 and 54 to the processing tray 61 are aligned one by one by the trailing edge regulation plates 62, the side regulation plates 63*a* and 63*b*, and the paddle 65. The sheets are positioned to a binding position of the binding unit 64 provided at a corner on one end side of the processing tray 61.

[Positioning]

The positioning will be further described in detail. As shown in FIG. 2, a sheet 30 carried out to the processing tray 61 with the trailing edge first is initially moved toward the trailing edge regulation plates 62 by rotation of the paddle 65. The trailing edge is abutted against the trailing edge regulation plates 62, whereby the sheet 30 is aligned in the carry-in direction to the processing tray 61.

With the trailing edge of the sheet 30 aligned, the left side shift motor M2 is driven to move the side regulation plate 63*a* toward the other side regulation plate 63*b* as shown in FIG. 3. The side regulation plate 63*a* makes contact with one side end of the sheet 30 and pushes the sheet 30 toward the side regulation plate 63*b*. As shown in FIG. 4, the other end of the sheet 30 in the width direction thus comes into contact with the side regulation plate 63*b*, whereby the sheet 30 is aligned in the width direction. The alignment position in the width direction here is set by driving the right side shift motor M3.

In the present example, the sheet 30 is aligned with reference to the left side. If the sheet 30 is aligned with reference to the right side, the right side shift motor M3 is driven to set the alignment position in the width direction. The left side shift motor M2 is then driven to move the side regulation plate 63*b* toward the side regulation plate 63*a*.

[Binding Unit]

Figure 5B:
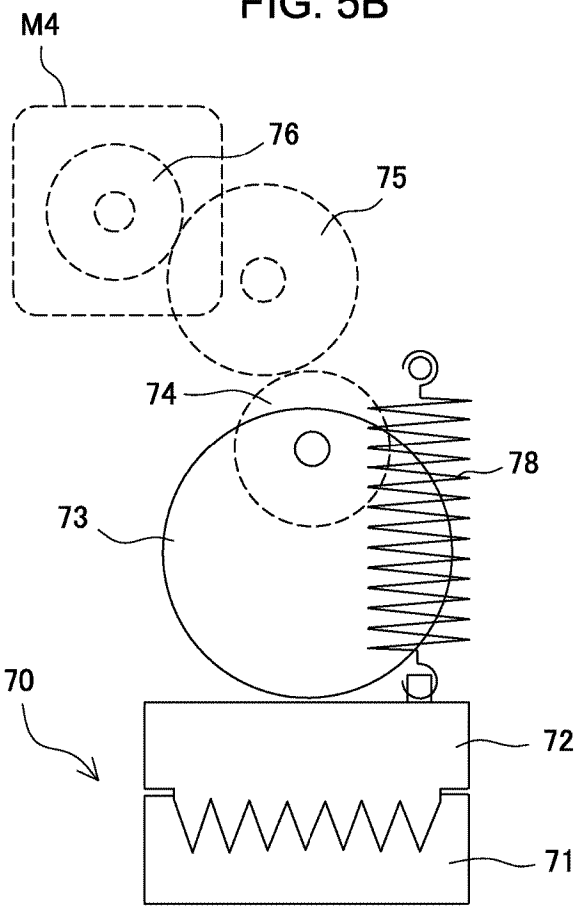
FIGS. 5A and 5B are side views showing a binding operation of a crimp binding member.
Figure 5A:
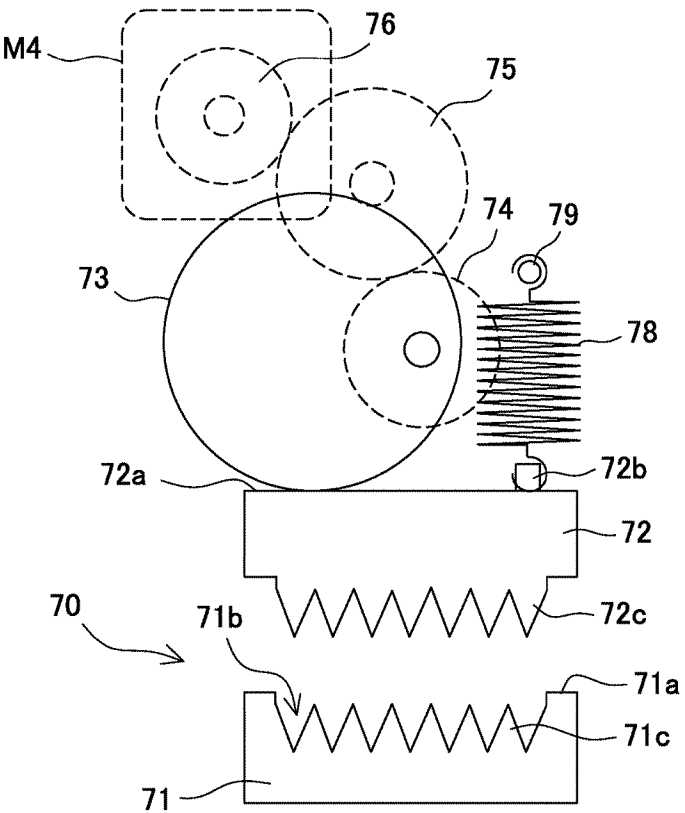

The binding unit 64 includes a crimp binding member 70 serving as a binding unit for applying binding to sheets. As shown in FIGS. 5A and 5B, the crimp binding member 70 includes a lower tooth 71 and an upper tooth 72. The lower tooth 71 is arranged on a sheet placing surface side of the processing tray 61. The upper tooth 72 is opposed to the lower tooth 71. The pair of tooth molds performs so-called crimp binding by sandwiching and pressing a sheet bundle therebetween to stretch, deform, and press the sheets so that fibers of the sheets are entangled with each other.

The lower tooth 71 of the crimp binding member 70 is provided so that its top surface 71*a* is flush with the sheet placing surface of the processing tray 61. Binding teeth 71*c* of recessed and protruded shape are formed on the inner bottom of a groove portion 71*b*. Binding teeth 72*c* of recessed and protruded shape to mesh with the binding teeth 71*c* of the lower tooth 71 are formed on the bottom surface of the upper tooth 72.

An eccentric cam 73 is in contact with a top surface 72*a* of the upper tooth 72. Rotation of the eccentric cam 73 moves the upper tooth 72 downward so that the binging teeth 72*c* of the upper tooth 72 mesh with the binding teeth 71*c* of the lower tooth 71. The sheets between the binding teeth 72*c* of the upper tooth 72 and the binding teeth 71*c* of the lower tooth 71 are thereby pressed to expose fibers on the surfaces of the sheets, and the fibers of the sheets are entangled with and fastened to each other.

The eccentric cam 73 is connected to a binding motor M4 via drive transmission gears 74, 75, and 76. The eccentric cam 73 is configured so that if the binding motor M4 is driven to rotate the eccentric cam 73 by a half turn, the upper tooth 72 moves from a standby position to a meshing position and moves to the standby position again. That is, the crimp binding member 70 presses and binds the sheets as the eccentric cam 73 is rotated by a half turn.

A tension spring 78 is provided to move the upper tooth 72 to the standby position. One end of the tension spring 78 is attached to an attachment tab 72*b* formed on the top surface 72*a* of the upper tooth 72. The other end is attached to an attachment pin 79 provided on a side plate (not shown) of the apparatus. As shown in FIG. 5A, the tension spring 78 thus pulls up and moves the upper tooth 72 to the standby position according to the rotation of the eccentric cam 73. As shown in FIG. 5B, if the eccentric cam 73 is rotated further, the eccentric cam 73 moves the upper tooth 72 to the meshing position against the pulling force of the tension spring 78.

As described above, the binding unit 64 integrally includes the crimp binding member 70, the eccentric cam 73, the drive transmission gears 74, 75, and 76, the binding motor M4, and the tension spring 78. The binding unit 64 is configured to move along one side of the sheets on the processing tray 61 according to a guide groove 80 formed near the end portion of the processing tray 61.

A pair of slide pins 67*a* and 67*b* are provided in parallel on an end portion of the binding unit 64. The slide pins 67*a* and 67*b* are engaged with the guide groove 80 which is formed in a unit frame along the sheet width direction. A unit moving mechanism 69 (FIG. 6) enables the binding unit 64 to reciprocate along the guide groove 80. Although not shown in particular, the unit moving mechanism 69 includes a rack mechanism or a belt mechanism that converts rotational motion into linear reciprocation motion.

The slide pin 67*a* serves as a rotation fulcrum about which the binding unit 64 swings. The guide groove 80 is formed to branch out at one end, and configured so that the slide pin 67*b* enters a branch part 80*a*. When the slide pin 67*b* enters the branch part 80*a*, the binding unit 64 swings with the slide pin 67*a* as the fulcrum, and changes its orientation from a state of being directly opposed to the sheets to a state of being obliquely opposed to the sheets.

The crimp binding member 70 is configured to be capable of reciprocation by itself in a direction orthogonal to the width direction, aside from movement by the binding unit 64 in the width direction of the sheets. The crimp binding member 70 includes a binding member moving mechanism 49 (FIG. 6) for reciprocating the upper tooth 72 and the lower tooth 71 in that direction. Although a specific configuration of the binding member moving mechanism 49 is not shown in the drawings, the binding member moving mechanism 49 includes a publicly-known endless belt or rack mechanism. As will become clear later, the binding member moving mechanism 49 serves as a moving unit for shifting the binding position of the crimp binding member 70 with respect to the sheets.

[Sheet Surface State Detection Device]

Figure 7A:
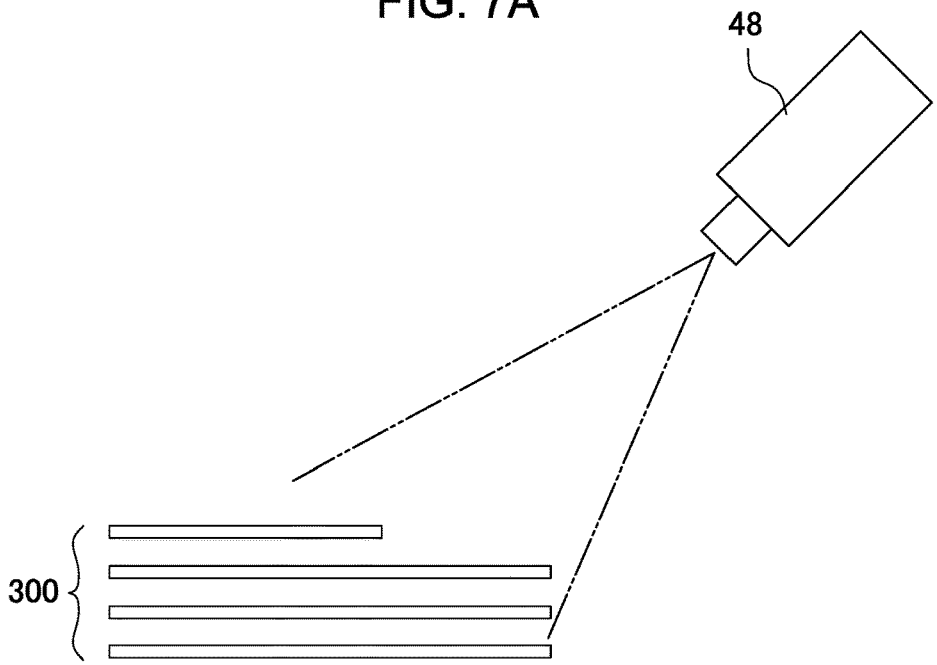
FIGS. 7A and 7B show operation explanatory diagrams of a sheet surface state detection device.
Figure 7B:
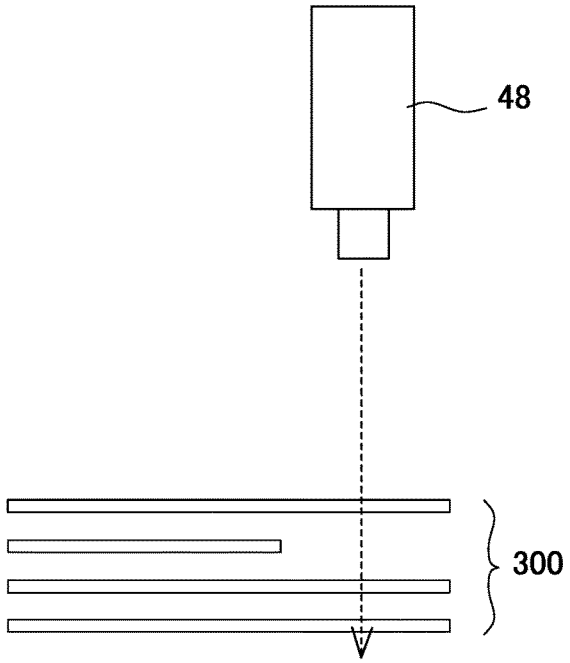

The binding unit 64 further includes a sheet surface state detection device 48 which is a detection unit for detecting a sheet surface state of the sheets 30 in a predetermined region where the crimp binding member 70 performs binding processing. For example, as shown in FIG. 7A, the sheet surface state detection device 48 recognizes an image of a sheet bundle 300 stacked on the processing tray 61 obliquely from above by using an image recognition sensor. The sheet surface state detection device 48 thereby detects a sheet surface state including whether the sheets 30 are broken, are partly missing, or have previously-formed crimps, projections and depressions, or holes resulting from stapling in a predetermined region (hereinafter, referred to as a default region) set in advance to apply binding to the sheet bundle 300. In FIG. 7B, the sheet surface state detection device 48 uses an ultrasonic sensor. The sheet surface state detection device 48 perpendicularly applies ultrasonic waves to the default region of the sheet bundle 300 and detects breakage, missing, and crimps of the sheets. The sheet surface state detection device 48 is not limited to ultrasonic waves, and may irradiate the sheets with light and detect the sheet surface state from the amount of transmitted light or reflected light. If the sheets 30 are made of material easy to be electrostatically charged, the foregoing problems can be detected from a change in capacitance.

[Control Configuration]

Figure 6:
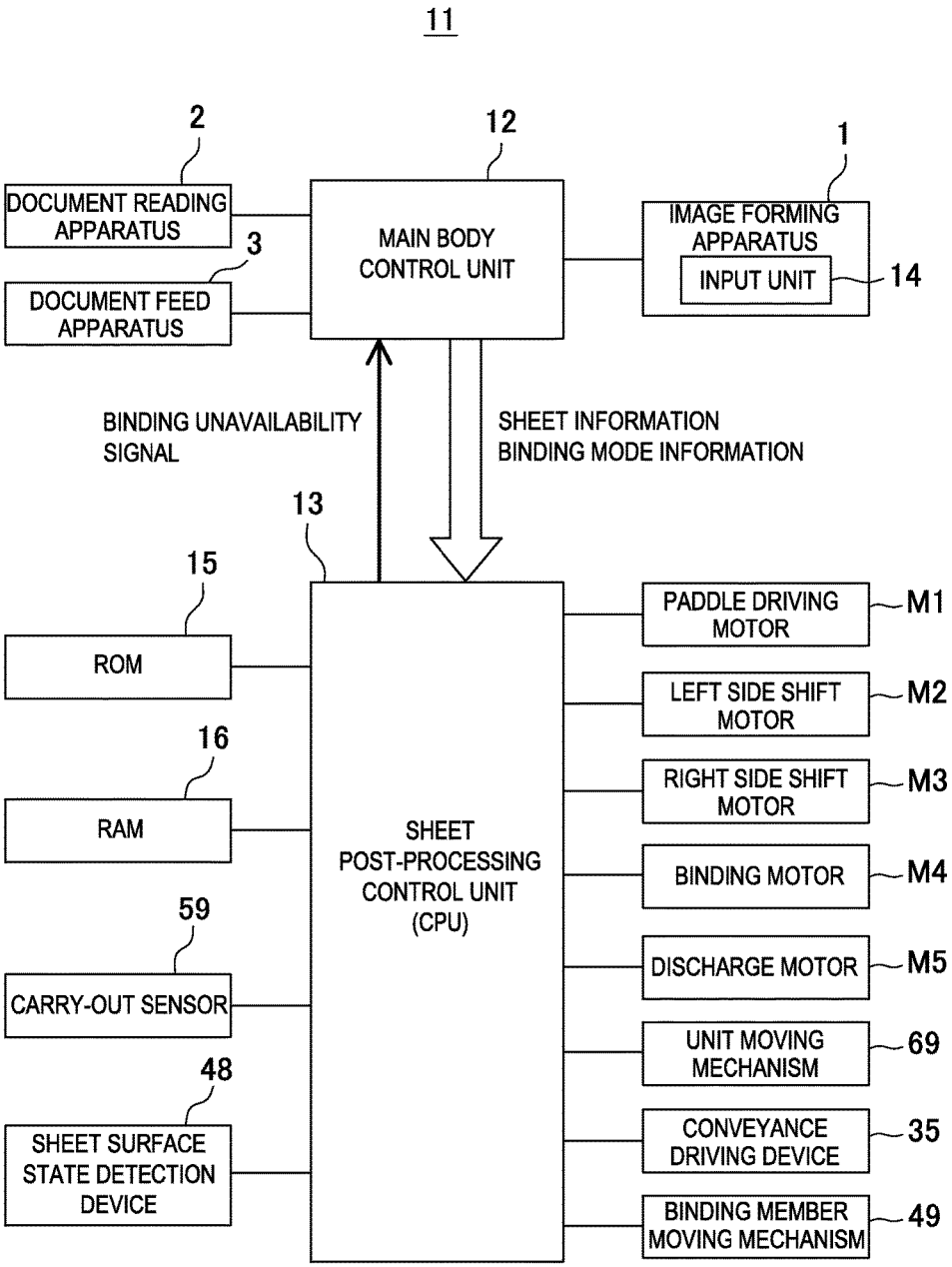
FIG. 6 shows a schematic view of a control configuration of the entire image forming system.

A configuration of a control apparatus 10 of the image forming system will be described with reference to FIG. 6.

The control apparatus 10 includes a main body control unit 12*a* and a sheet post-processing control unit 13*a*. The main body control unit 12*a* controls operations of the image forming apparatus 1, the document reading apparatus 2, and the document feed apparatus 3. The sheet post-processing control unit 13*a* controls the sheet post-processing apparatus 4.

The image forming apparatus 1 includes an input unit 14*a* which includes a not-shown control panel. The input unit 14*a* is arranged on a front side where the user of the image forming system is positioned. The input unit 14*a* includes an operation panel, and the user of the image forming system inputs image finishing specifications, the size of sheets to be printed, binding specifications, and the like from the input unit 14*a*. There are two binding modes, including a corner binding mode in which sheets are bound at a corner and a two-point binding mode in which sheets are bound at two positions on one side. The user selects either one of the modes.

The main body control unit 12*a* controls the image forming apparatus 1, the document reading apparatus 2, and the document feed apparatus 3 according to the contents input to the input unit 14*a*. The main body control unit 12*a* thereby prints read document images on sheets as many as specified, and sequentially sends the printed sheets to the sheet post-processing apparatus 4. The main body control unit 12*a* also outputs sheet information indicating a sheet size, the number of sheets, and the like, and binding mode information about the binding method specified by the user to the sheet post-processing control unit 13*a* based on the contents input to the input unit 14*a*. The sheet post-processing control unit 13*a* outputs a binding unavailability signal to the main body control unit 12*a*.

The sheet post-processing control unit 13*a* controls a post-processing operation which is performed on the image-formed sheets delivered from the image forming apparatus 1. The sheet post-processing control unit 13*a* includes a CPU, and controls an operation of the entire sheet post-processing apparatus 4 by executing a control program stored in a ROM 15*a*. The sheet post-processing control unit 13*a* is therefore connected with the binding motor M4, the paddle driving motor M1, the left and right side shift motors M2 and M3, the sheet surface state detection device 48, the binding member moving mechanism 49, the unit moving mechanism 69, a conveyance driving device 35, and the carry-out sensor 59. The binding motor M4 drives the eccentric cam 73 of the crimp binding member 70. The paddle driving motor M1 drives the paddle 65 to rotate. The conveyance driving device 35 includes a plurality of driving motors for driving the conveyance roller pairs arranged on the conveyance paths 53, 54, and 55, and the discharge roller pair 60.

[Binding Operation]

Figure 8:
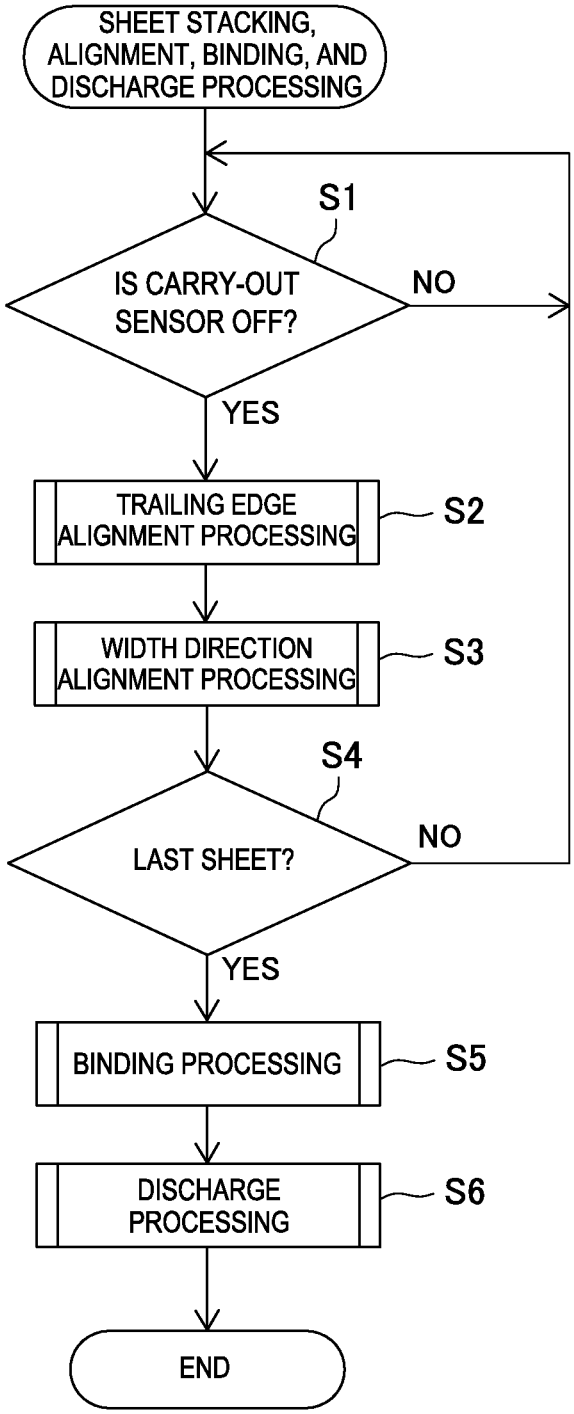
FIG. 8 shows a flowchart for describing an operation of the sheet post-processing apparatus.

The binding operation by the sheet post-processing apparatus 4 will be described with reference to the flowchart shown in FIG. 8. The sheet post-processing control unit 13*a* initially determines by using the carry-out sensor 59 whether a sheet is carried out onto the processing tray 61 (step S1). The carry-out sensor 59 turns on if a sheet carried out to the discharge port 58 is detected. If the sheet is let into the processing tray 61 from the discharge port 58, the trailing edge of the sheet goes off the detection region and the carry-out sensor 59 turns off. If the carry-out sensor 59 switches from on to off, the sheet post-processing control unit 13*a* therefore determines that a sheet is carried out onto the processing tray 61 ("YES" in step S1). The sheet carried out to the processing tray 61 can be one delivered through the first conveyance path 53 or one delivered through the second conveyance path 54 which guides a sheet from the sheet feed tray 52 to the sheet binding processing apparatus 50.

The sheet post-processing control unit 13*a* then controls the driving of the paddle control motor M1 to control a trailing edge alignment operation of the sheet discharged to the processing tray 61 (step S2). As shown in FIG. 2, the sheet 30 moves in a direction opposite to the sheet carry-out direction from the discharge port 58. As shown in FIG. 3, the trailing edge of the sheet 30 is thereby abutted against and aligned by the trailing edge regulation plates 62.

After the alignment of the trailing edge of the sheet 30 ends, the sheet post-processing control unit 13*a* controls an alignment operation in the width direction (step S3). Specifically, the sheet post-processing control unit 13*a* moves the first side regulation plate 63*a* toward the second side regulation plate 63*b*. One end of the sheet 30 in the width direction is thus pushed by the first side regulation plate 63*a*, and the sheet 30 moves toward the second side regulation plate 63*b*. The other end of the sheet 30 in the width direction then comes into contact with the second side regulation plate 63*b*, whereby the sheet 30 is also aligned in the width direction as shown in FIG. 4.

The distance by which the sheet post-processing control unit 13*a* moves the first side regulation plate 63*a* toward the second side regulation plate 63*b* is determined by the sheet size included in the sheet information about the sheet 30, output from the main body control unit 12*a*. More specifically, the sheet post-processing control unit 13*a* moves the first side regulation plate 63*a* to a position at which the distance between the side regulation plates 63*a* and 63*b* is slightly shorter than the length of the sheet 30 in the width direction.

Next, the sheet post-processing control unit 13*a* determines whether the sheet 30 positioned by the alignment of the trailing edge and the width direction on the processing tray 61 is the last sheet. Binding processing is performed on a sheet bundle including more than one sheet. While the carry-out sensor 59 repeats on and off by detecting subsequent sheets in succession, the sheet post-processing control unit 13*a* determines that the sheet 30 aligned immediately before is not the last one ("NO" in step S4). The sheet post-processing control unit 13*a* then returns to step S1 and repeats the processing of step S2 and subsequent steps. The sheets 30 sequentially delivered from the discharge port 58 are thus stacked on the processing tray 61.

In the processing of step S4, if the carry-out sensor 59 turns off and does not turn on after a lapse of a certain time, the sheet post-processing control unit 13*a* determines that the sheet 30 aligned immediately before is the last one ("YES" in step S4). The sheet post-processing control unit 13*a* then performs binding processing in step S5.

Figure 9:
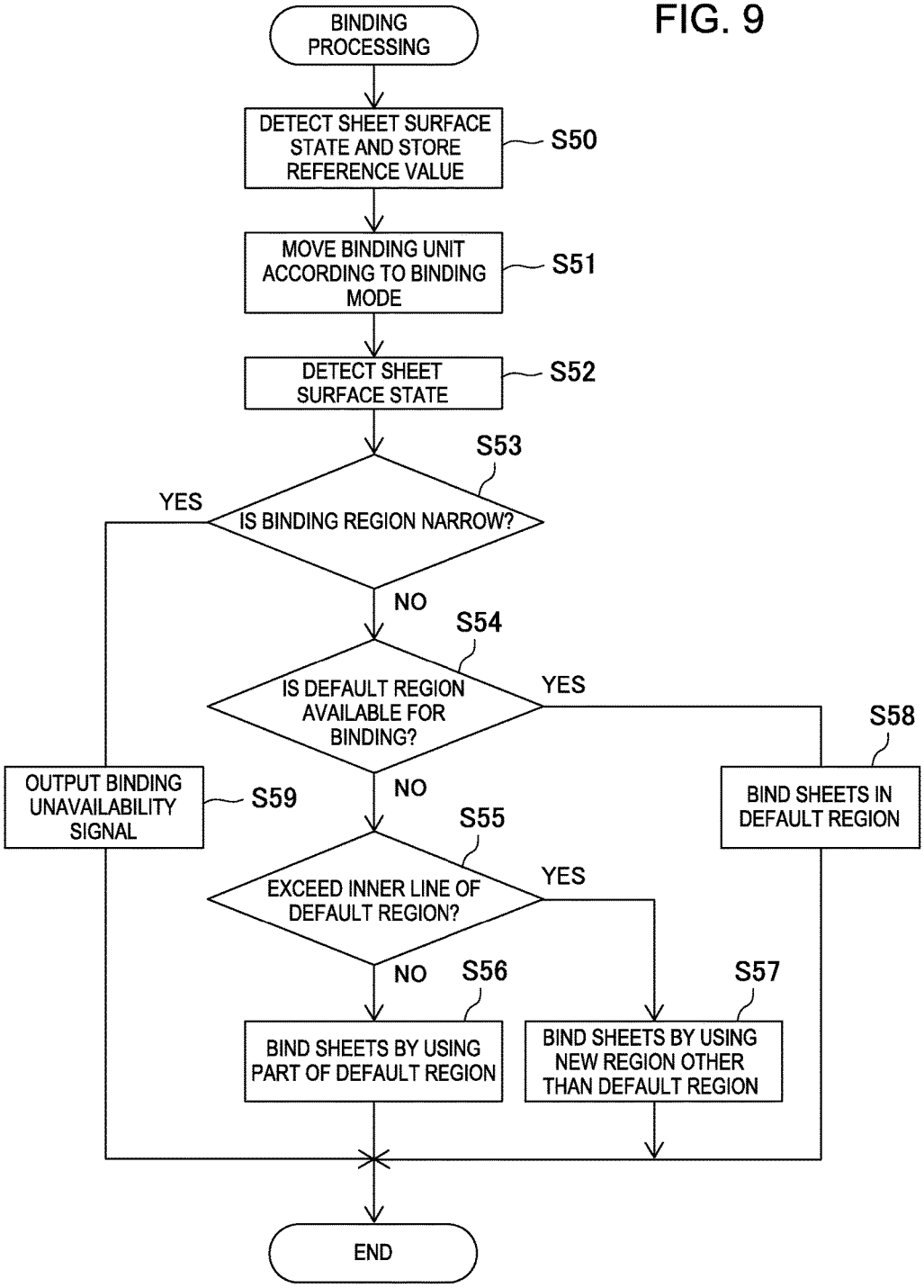
FIG. 9 shows a flowchart for describing an operation of binding processing.

The binding processing in step S5 is performed by the operation shown in the flowchart of FIG. 9. In the binding processing, the sheet post-processing control unit 13*a* detects the sheet surface state of the sheets by using the sheet surface state detection device 48 (step S50). Here, as shown in FIG. 4, the binding unit 64 is located at a home position HP of the processing tray 61 and is not opposed to the sheets 30. In step S50, the sheet post-processing control unit 13*a* therefore operates the unit moving mechanism 69 to move the binding unit 64 in a direction parallel to one side of the sheets 30 so that the sheet surface state detection device 48 is opposed to part of the side end of the sheets 30 as shown by broken lines in FIG. 4. Such an opposed position lies outside a default region 30*a* that is set in advance to perform the binding processing by the crimp binding member 70. The sheet post-processing control unit 13*a* stores the output value of the sheet surface state detection device 48 here as a reference value for determining the sheet surface state afterward.

Figure 10:
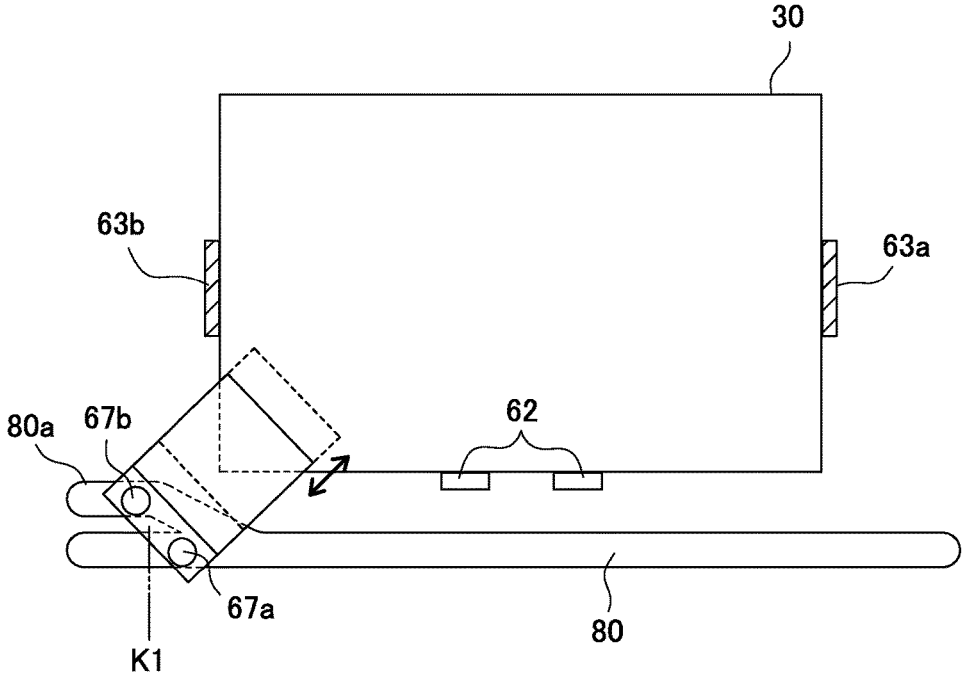
FIG. 10 shows an explanatory diagram of an operation in a corner binding mode.
Figure 11:
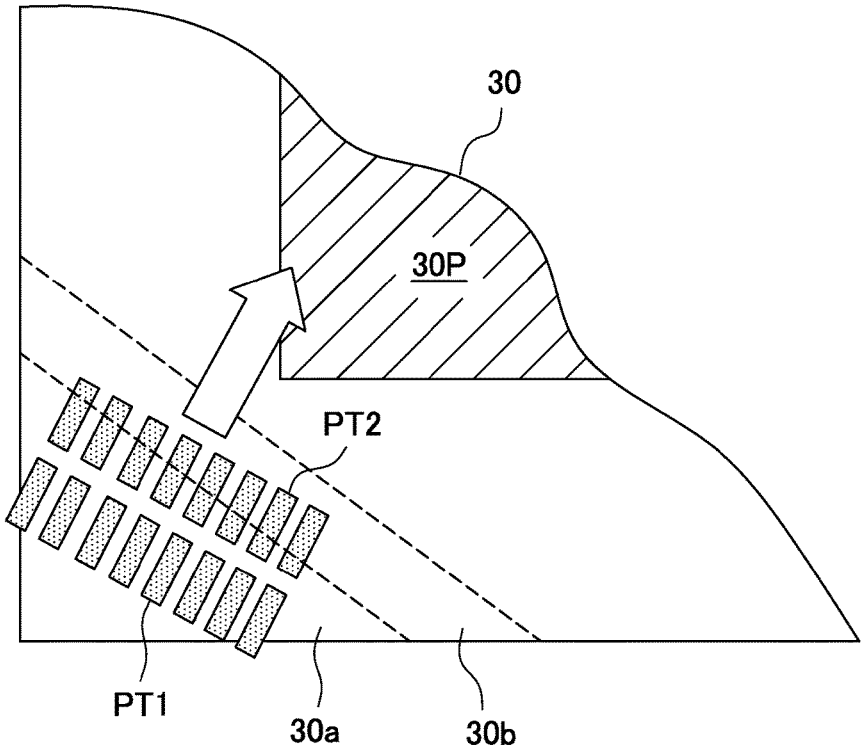
FIG. 11 shows a schematic diagram for describing a change in a binding position in the corner binding mode.

If the corner binding mode is designated, the sheet post-processing control unit 13*a* then controls the unit moving mechanism 69 to stop the binding unit 64 at a predetermined stop position K1 at an end portion of the one side of the sheets 30 as shown in FIG. 10 (step S51). At the stop position K1, the slide pin 67*b* enters the branch part 80*a* and the binding unit 64 swings. The binding unit 64 is tilted and opposed to the corner portion of the sheets 30, whereby the crimp binding member 70 is located over the default region 30*a* to perform binding. FIG. 11 shows the corner portion of the sheets 30 when the corner binding is performed. In the case of the corner binding, the default region 30*a* is triangular. The default region 30*a* is set in advance to a position not overlapping with a print image 30P formed on the center of a sheet 30.

If the binding unit 64 reaches the stop position K1, the sheet post-processing control unit 13*a* obtains the output value (measurement value) of the sheet surface state detection device 48 or image data here. The sheet post-processing control unit 13*a* detects the sheet surface state of the default region 30*a* by comparing the output value or image data with the reference value stored by the processing of step S51 or a reference image (step S52).

The present embodiment employs a configuration in which the sheet surface state detection device 48 is integrated into the binding unit 64, and detects the default region 30*a* at the stop position K1 of the binding unit 64. However, the sheet surface state detection device 48 may be configured as a member separate from the binding unit 64, and may be arranged at a position away from the binding unit 64. The sheet surface state detection device 48 then can detect the sheet surface state of the default regions of the sheets 30 during a moving operation for moving the sheets 30 conveyed to a sheet placing unit to the binding position, before the sheets 30 and the binding unit 64 are located at the binding position.

If the sheet surface state detection device 48 is provided in a position different from the binding position, the sheets may be conveyed to the binding position after detection. In such a case, a configuration for detecting the sheet surface state of the sheets one by one or stacking a plurality of sheets into a bundle at the detection position may be employed so that the sheet surface state of the default region 30*a* is detected each time a sheet is stacked. In such a case, a configuration for detecting a state of the default region 30*a* in the stacking height direction when a predetermined number of sheets are stacked may also be used.

Next, suppose that the sheet surface state of the default region 30*a* shows any of the aforementioned problems, and the sheet information transmitted from the main body control unit 12*a* shows that the sheet size is small and the region to be bound is narrow or a distance between the default region 30*a* and the print image 30P is small. In such a case, the sheet post-processing control unit 13*a* outputs the binding unavailability signal indicating that the binding processing is not possible to the main body control unit 12*a* (step S59). The main body control unit 12*a* then notifies the user that binging is not available.

If there is room for binding ("NO" in step S53), the sheet post-processing control unit 13*a* determines, based on the detection result of step S52, whether the binding processing can be applied to the default region 30*a* (step S54). If the sheet surface state is such that crimp binding can be performed on the default region 30*a* without a problem, the sheet post-processing control unit 13*a* controls the driving of the binding motor M4 to actuate the crimp binding member 70 and apply binding to the default region 30*a* (step S58). The sheet post-processing control unit 13*a* then controls the driving of the unit moving mechanism 69 to return the binding unit 64 to the home position HP, and ends the binding processing.

On the other hand, if the default region 30*a* is not available for the binding processing, binding is applied by forming crimps PT2 in a position closer to the diagonal center of the sheets 30 than the default region 30*a* is, as shown by the arrow in FIG. 11. For example, suppose that there is breakage or missing of a sheet, or crimps PT1 are already formed as shown in FIG. 11, in the default region 30*a* ("NO" in step S54). In such a case, the sheet post-processing control unit 13*a* determines whether crimps PT2 to be formed by new binding exceed the inner line of the triangular default region 30*a*, i.e., the base of the triangle (step S55).

Figure 14A:
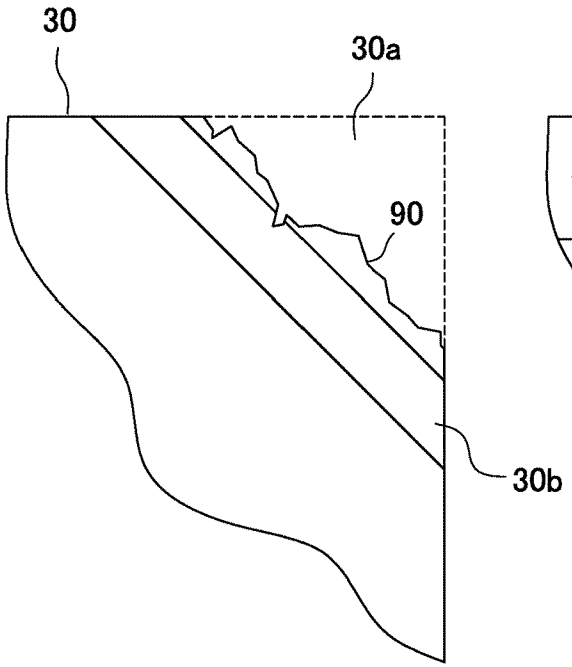
FIGS. 14A to 14C are explanatory diagrams showing problems in the binding region of sheets detected by the sheet surface state detection device.
Figure 14B:
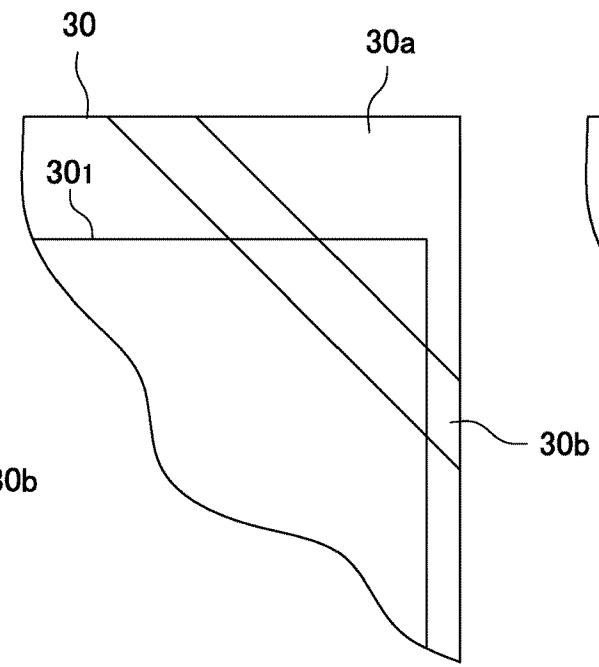
Figure 14C:
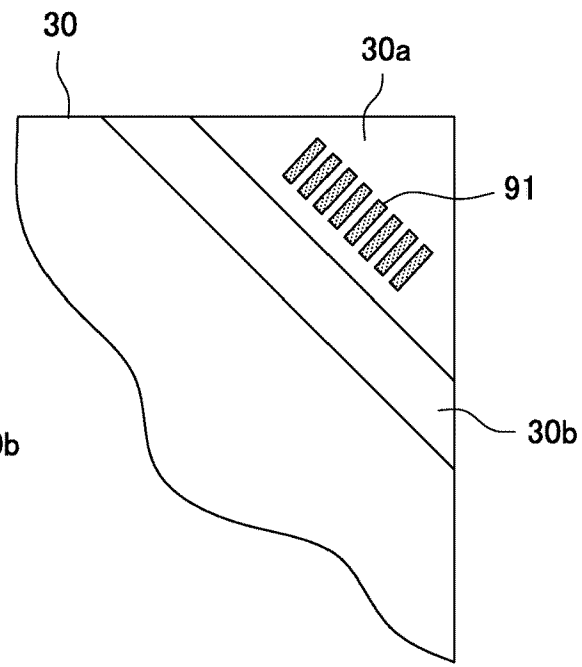

FIGS. 14A to 14C show examples of states in which there is breakage or missing of a sheet, or crimps are already formed, and the default region 30*a* is not available for crimp binding. FIG. 14A shows an example in which there is breakage (including formation of a perforated portion) 90. FIG. 14B shows an example in which one of the stacked sheets, $\mathbf{30}_1$, is not aligned and missing from the binding position. FIG. 14C shows an example in which crimps 91 are already formed.

If the binding processing can be performed to overlap with the default region 30*a*, the sheet post-processing control unit 13*a* performs a binding operation by using part of the default region 30*a* (step S56). On the other hand, if the binding process is unable to be performed to overlap with the default region 30*a*, the sheet post-processing control unit 13*a* performs a binding operation on a new different binding region 30*b* diagonally closer to the sheet center than the default region 30*a* is (step S57).

By the binding operation of step S56, crimping is thus applied so that crimps PT2 are formed in a position farther from the print images 30P formed on the center of the sheets 30. In the processing of step S56 or S57, the sheet post-processing control unit 13*a* controls the binding member moving mechanism 49, which is the moving unit of the crimp binding member 70 for shifting the binding position of the sheets 30, to move the crimp binding member 70 on the diagonal line of the sheets 30. Next, the sheet post-processing control unit 13*a* controls the driving of the binding motor M4 to apply binding. The sheet post-processing control unit 13*a* then controls the driving of the unit movement mechanism 69 to return the binding unit 64 to the home position HP, and ends the binding processing. Now, returning to the description of the flowchart of FIG. 8, the sheet post-processing control unit 13*a* controls the driving of the discharge motor M5 to discharge the sheets 30 binding-processed on the processing tray 61 to the second discharge tray 57 (step S6).

Figures 12A, 12B, 12C:
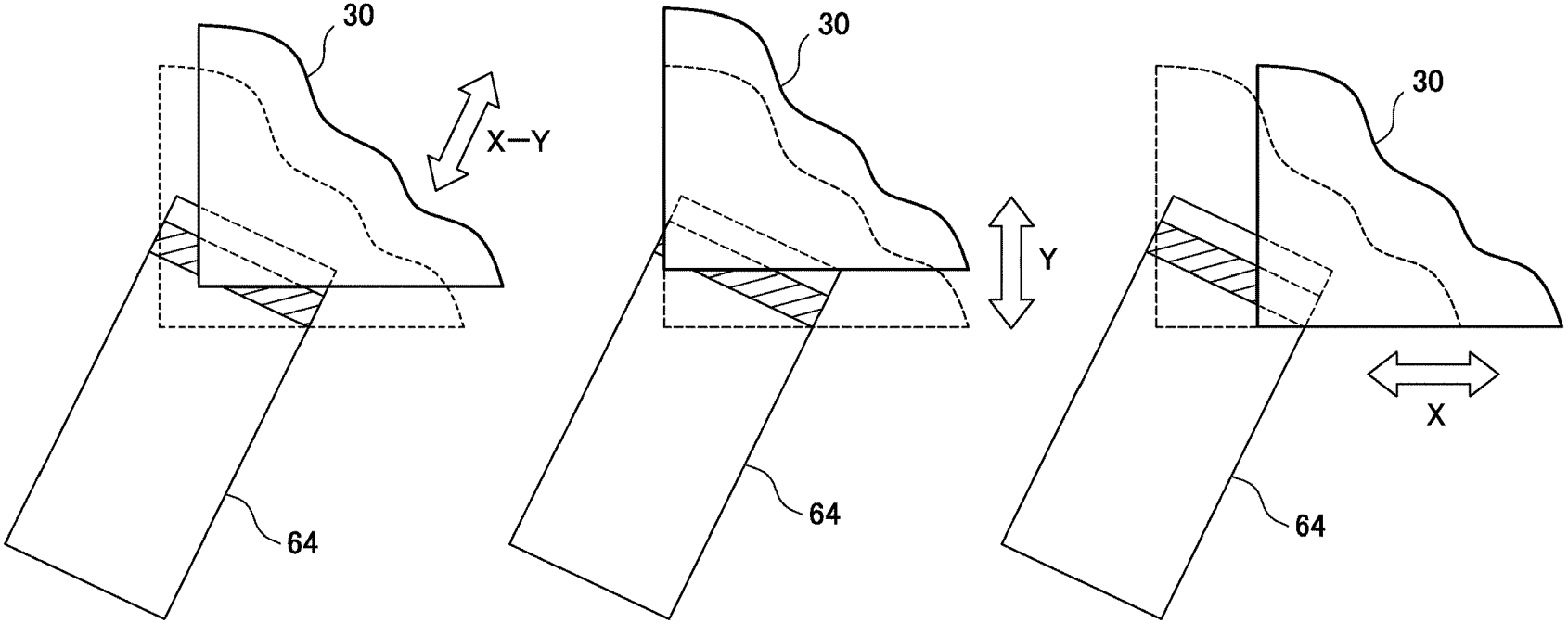
FIGS. 12A to 12C show schematic diagrams for describing the changing of the binding position by moving the sheet in the corner binding mode.

In the foregoing example, the binding position is shifted by moving the crimp binding member 70 by the binding member moving mechanism 49. However, the position of the sheets 30 may be changed with respect to the crimp binding member 70. The position of the sheets 30 can be changed by using any of the following methods. As shown in FIG. 12A, one method is to change the regulation positions of both the first and second side regulation plates 63*a* and 63*b* and the trailing edge regulation plates 62 to adjust the position of the sheets 30 in X- and Y-axis directions. As shown in FIG. 12B, another method is to change the regulation position of the trailing edge regulation plates 62 to make an adjustment in the Y-axis direction of the sheets 30. As shown in FIG. 12C, another method is to change the regulation positions of the first and second side regulation plates 63*a* and 63*b* to make an adjustment in the X-axis direction of the sheets 30. If the binding position is shifted by moving the sheets, the left side shift motor M2 and the right side shift motor M3 serve as the moving unit and the first and second side regulation plates 63*a* and 63*b* and/or the trailing edge regulation plates 62 serve as a binding position change unit.

Figure 13:
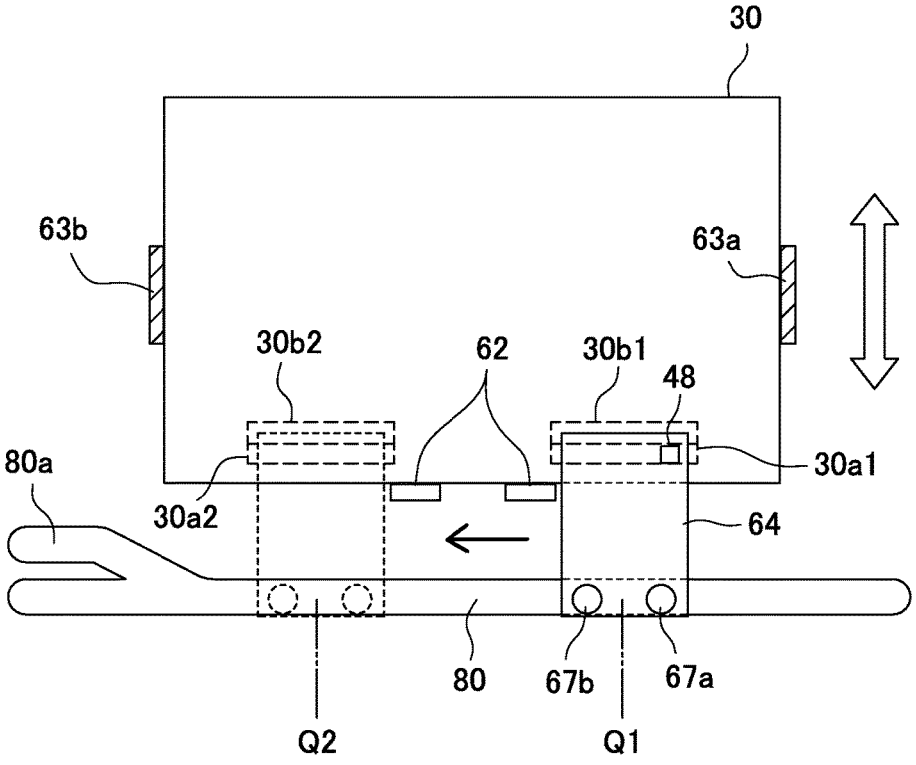
FIG. 13 shows an explanatory diagram of an operation in a two-point binding mode.

The binding processing in the corner binding mode has been described above. In the case of two-point binding, as shown in FIG. 4, the binding unit 64 located at the home position HP is moved in the direction parallel to the one side of the sheets 30 to apply binding to the sheets 30 at two binding positions Q1 and Q2 as shown in FIG. 13. The regions to be opposed to the crimp binding member 70 of the binding unit 64 at the binding positions Q1 and Q2 of the sheets 30 are set as default regions 30*a*1 and 30*a*2.

In the two-point binding mode, the sheet post-processing control unit 13*a* controls the unit moving mechanism 69 to move the binding unit 64 to the binding position Q1 in the processing of step S51. In the processing of step S52, the sheet post-processing control unit 13*a* detects the sheet surface state of the default region 30*a*1 of the sheets 30 at the binding position Q1. If the default region 30*a*1 is not available for binding, the sheet post-processing control unit 13*a* performs control to change a relative position between the sheets 30 and the crimp binding member 70 by moving either the sheets 30 or the crimp binding member 70 in the direction of the outlined arrow so that a binding operation is performed on a new binding region 30*b*1 that is closer to the center of the sheets 30 than the default region 30*a*1 is.

If the binding operation at the binding position Q1 ends, the sheet post-processing control unit 13*a* controls the unit moving mechanism 69 to move the binding unit 64 to the binding position Q2. The sheet post-processing control unit 13*a* then performs control so that a binding operation is performed on a new binding region 30*b*2 at the binding position Q2.

When the sheet binding processing apparatus 50 described above performs the crimp binding processing operation, the sheet surface state detection device 48 detects the state of the sheet surface of the sheets in the default region where a binding position is defined in advance. If the default region is not determined to be available for binding, the sheet binding processing apparatus 50 performs crimping on a position closer to the center of the sheets 30, other than the default region. If the shifted new crimping position overlaps with a printed portion of the sheets, the sheet binding processing apparatus 50 quits the crimp binding operation. In particular, if crimps are formed in the default region of the sheets 30, the sheet binding processing apparatus 50 can avoid performing crimping further on the crimps, so that the portion of the default region will not be stretched out or broken by the additional crimping.

This application claims priority based on Japanese Patent Application No. 2016-179232, filed Sep. 14, 2016, and Japanese Patent Application No. 2016-179233, filed Sep. 14, 2016, all the contents of which are incorporated herein.

What is claimed is:

1. A sheet binding processing apparatus comprising:

a crimp binding member that performs binding processing on a predetermined region of a sheet by sandwiching and pressing the sheet between an upper tooth and a lower tooth meshing with each other; and a detection unit that detects a state of the predetermined region of the sheet to be bound by the crimp binding member, wherein if the detection unit detects that the predetermined region is not capable of binding, the binding processing on the predetermined region is prohibited.

2. The sheet binding processing apparatus according to claim 1, comprising a moving unit that relatively changes a binding position of the crimp binding member with respect to the sheet, wherein if the detection unit detects that the predetermined region is not capable of binding, the moving unit changes the binding position of the crimp binding member with respect to the sheet so that a position different from the predetermined region is bound.

3. The sheet binding processing apparatus according to claim 2, wherein the moving unit moves the binding position to the position different from the predetermined region, the position being close to a center of the sheet.

4. The sheet binding processing apparatus according to claim 3, wherein the moving unit moves the crimp binding member.

5. The sheet binding processing apparatus according to claim 2, comprising:

a placing unit on which a sheet is placed; and an alignment unit that aligns the sheet placed on the placing unit, wherein the moving unit moves the alignment unit.

6. The sheet binding processing apparatus according to claim 1, wherein the detection unit detects whether there is a crimp formed by previous crimp binding processing in the predetermined region.

7. The sheet binding processing apparatus according to claim 1, wherein the detection unit detects breakage of the sheet at a predetermined binding position of a sheet bundle.

8. The sheet binding processing apparatus according to claim 1, wherein the detection unit detects an alignment failure at a predetermined binding position of a sheet bundle.

9. The sheet binding processing apparatus according to claim 1, wherein the detection unit detects a stapling trace at a predetermined binding position of a sheet bundle.

10. The sheet binding processing apparatus according to claim 1, wherein the detection unit detects a perforated portion at a predetermined binding position of a sheet bundle.

11. The sheet binding processing apparatus according to claim 1, wherein the detection unit detects missing of a sheet included in a sheet bundle at a sheet binding processing position of the sheet.

12. The sheet binding processing apparatus according to claim 1, wherein if an area of the predetermined region capable of the binding processing is smaller than a predetermined size, the detection unit prohibits the binding processing from being performed.

13. A sheet post-processing apparatus comprising:

a sheet feed tray on which a sheet is set from outside by a manual operation; and a sheet binding processing apparatus that applies binding processing to a sheet carried out from the sheet feed tray, wherein the sheet binding processing apparatus includes a configuration according to claim 1.

14. An image forming system comprising:

an image forming apparatus that prints an image on sheets and carries out the sheets in succession; and a sheet post-processing apparatus that performs post-processing on the sheets carried out from the image forming apparatus, wherein the sheet post-processing apparatus includes the sheet binding processing apparatus according to claim 1.

* * * * *